US005577614A

United States Patent [19]

Palmeroni, Jr. et al.

[11] Patent Number: 5,577,614

[45] Date of Patent: Nov. 26, 1996

[54] COMBINED SHIPPING AND DISPENSING PACKAGE FOR FLUID CONTAINERS

[75] Inventors: Fernando Palmeroni, Jr., Rochester; Clark E. Harris, Fairport, both of N.Y.

[73] Assignee: Eastman Kodak Company, Rochester, N.Y.

[21] Appl. No.: 571,008

[22] Filed: Dec. 12, 1995

[51] Int. Cl.[6] ..... B65D 81/02

[52] U.S. Cl. ..... 206/521; 206/588; 206/526; 206/592

[58] Field of Search ..... 206/588, 589, 206/591–594, 521, 523, 446, 514, 526, 433, 427, 461, 470

[56] References Cited

U.S. PATENT DOCUMENTS

| | | | |
|---|---|---|---|
| 2,698,248 | 12/1954 | Peters | 99/171 |
| 2,768,106 | 10/1956 | Sartakoff | 154/83 |
| 2,959,340 | 11/1960 | Hennessey | 206/592 |
| 3,448,897 | 6/1969 | Sterling | 222/105 |
| 3,552,595 | 1/1971 | Gerner | 206/592 |
| 3,987,956 | 10/1976 | Congleton | 206/523 |
| 4,173,286 | 11/1979 | Stanko | 206/433 |
| 5,263,611 | 11/1993 | Trippen | 222/105 |

*Primary Examiner*—Paul T. Sewell
*Assistant Examiner*—Shian Lam
*Attorney, Agent, or Firm*—Francis H. Boos, Jr.

[57] ABSTRACT

A combined shipping and dispensing package for fluid containers has an outer container and an internal packing. The internal packing has mating support members, each having a rib section with openings with extending, compliant jacket walls that form cavities to receive and support the fluid containers. Collar portions are formed in the rib section and upper cavity walls to provide support for dispensing conduits extending outwardly of the fluid containers. Compliant spacer walls extend laterally from the rib section to provide lateral support and shock absorption for the jacketed cavities. The package may be used for direct positioning of the fluid container dispensing conduits onto mating fluid receptacles on associated processing equipment without removing the fluid containers from the package.

13 Claims, 3 Drawing Sheets

COMBINED SHIPPING AND DISPENSING PACKAGE FOR FLUID CONTAINERS

FIELD OF THE INVENTION

The invention relates generally to the field of fluid container packaging and, in particular, to packaging of liquid photo chemicals which serves the combined functions of shipping protection and dispensing convenience.

BACKGROUND OF THE INVENTION

Currently, liquid photo chemicals are shipped in bottles, both rigid and semi-rigid, collapsible containers, better known as "cubitainers" and in bag-in-box packaging. Dispensing of the liquid contents entails removing the cap of the container and pouring the contents into the appropriate containers in the associated photoprocessing equipment. In the case of bag-in-box packaging, the bag's neck and closure remain in the shipping box. For dispensing, the neck is accessed by removing a perforated area of the box. U.S. Pat. No. 3,448,897 shows an arrangement for dispensing of liquid from a flexible bag in which the bag is inserted into a rigid storage container and the neck of the bag is inserted through an aperture and dispensing valve device mounted on the exterior of the storage container. However, there is no suggestion that the storage container would be used for shipping and it requires an inconvenient and time consuming procedure for setting up the bag for dispensing. U.S. Pat. No. 5,263,611 shows a liquid soap bag disposed in a rigid container for use with a separate dispensing valve mechanism. However, there is no suggestion that the rigid container is suitable for shipping purposes and it appears likely that damage to the neck of the bag would occur during shipping unless additional measures would be taken to protect the neck at the point it projects through the rigid container.

There is a need, therefore, for a fluid container packaging that provides convenient dispensing by means of a dispensing neck or conduit that projects through the outer package container and at the same time protects the fluid container and, in particular, the neck portion, during the rough handling encountered during shipping.

SUMMARY OF THE INVENTION

In accordance with the invention, therefore, there is provided a combined shipping and dispensing package for enclosing at least one fluid container, the fluid container including a dispensing conduit having a retention channel on the outer periphery thereof, wherein the package comprises an outer container having a bottom wall, sidewalls, and a top closure, the top closure having an opening for extension therethrough of the dispensing conduit. The package also comprises internal packing means for flexibly holding the fluid container in a fixed position within the outer container, the packing means comprising first and second mating support members. Each support member has a substantially rigid, upstanding rib section having an opening defined therein, and a compliant jacket wall extending outwardly from the rib opening to form a partial cavity for receiving and supporting a fluid container placed in the cavity. Each support member also has a substantially rigid collar portion formed in the rib section at an upper portion of the cavity, the collar portion being shaped to engage the conduit retention channel of the fluid container when the fluid container is placed in the cavity. Each support member further includes a plurality of compliant spacer members extending laterally from the rib section. When the support members are mated together and inserted into the outer container with the fluid container in place, the ribs and collar portions form a centralized internal support wall resisting compressive forces on the dispensing conduit parallel to the support wall. The compliant spacer members hold the internal support wall in spaced relation from the outer container sidewalls thereby holding the dispensing conduit in lateral alignment with the top closure opening. Finally, the compliant spacer members and compliant jacket walls jointly provide shock absorption for the fluid container during shipping.

The package of the invention is uniquely adapted to accommodate a plurality of fluid containers which may each be of different size by provision of a plurality openings and associated jacket walls in the rib section, the sizes of the resultant cavities being adapted to fit the sizes of the fluid containers to be accommodated. Preferably, the collar portions for each of the cavities are positioned on the rib section in a common plane to thereby facilitate attaching the dispensing tubes to receiving conduits in associated photo processing equipment without removal of the fluid containers from the outer container.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
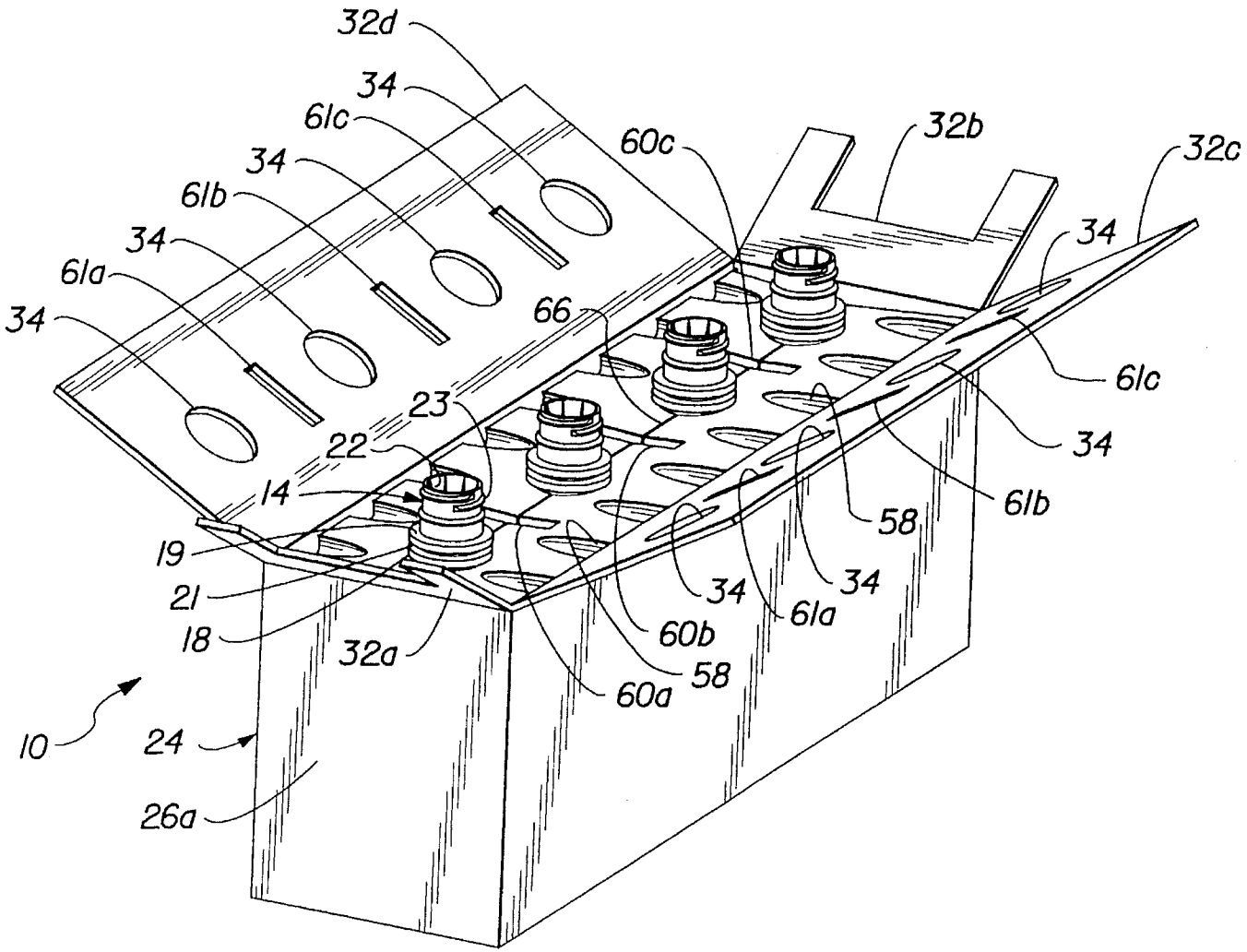
FIG. 1 is a perspective view of a combined shipping and dispensing package in accordance with the invention
Figure 2:
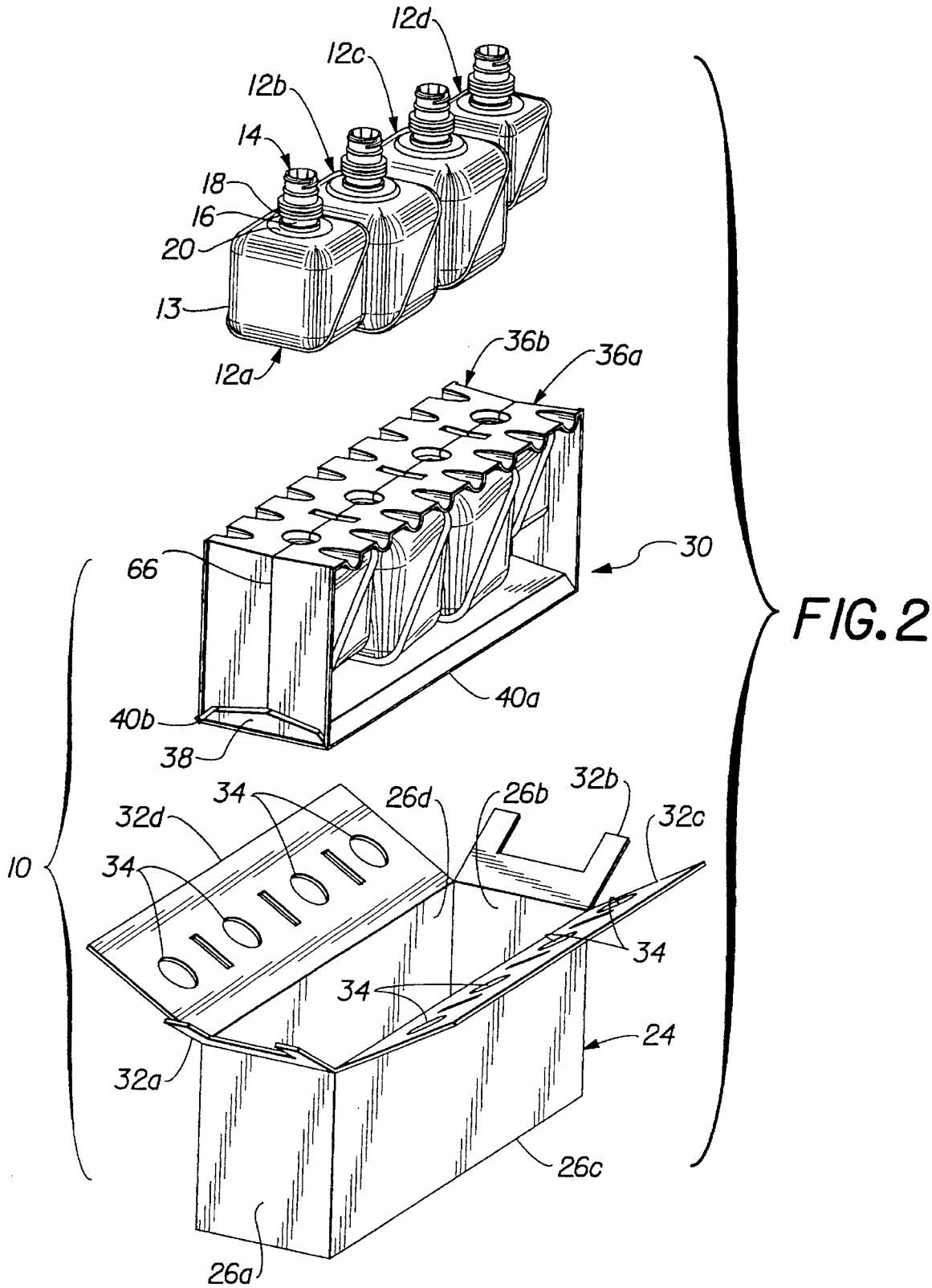
FIG. 2 is an exploded view in perspective of the package of FIG. 1.
Figure 3:
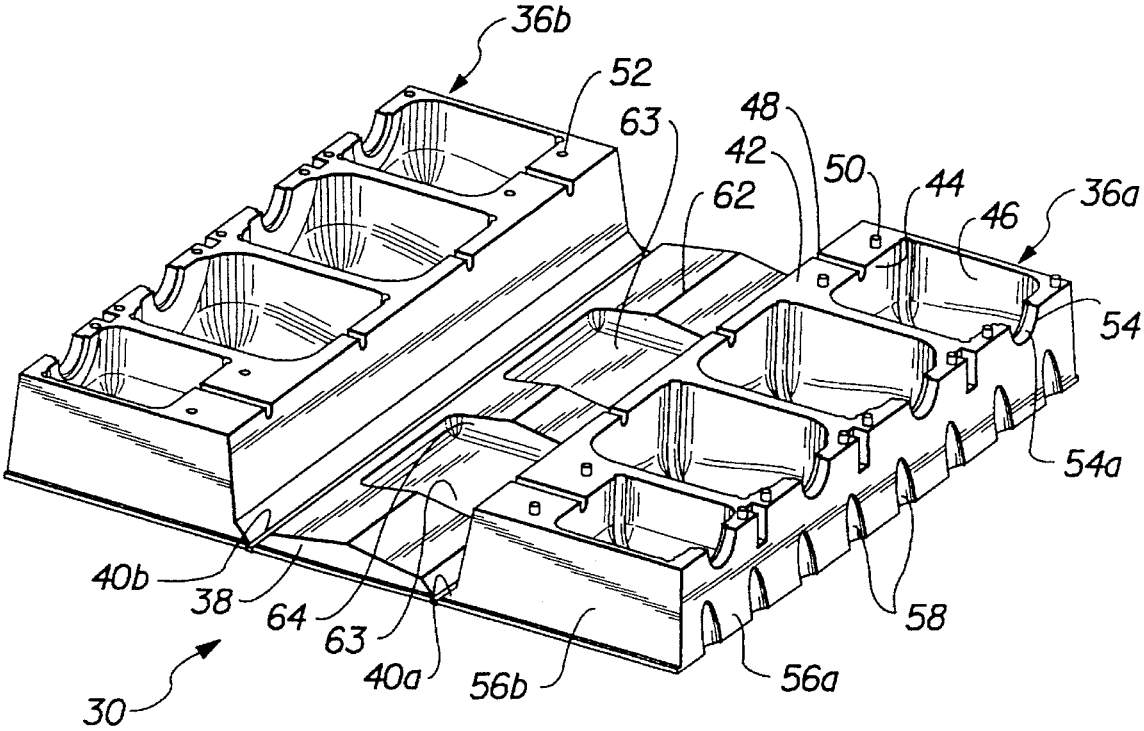
FIG. 3 is a perspective view of internal packaging means used in the combined package of the invention.
Figure 4:
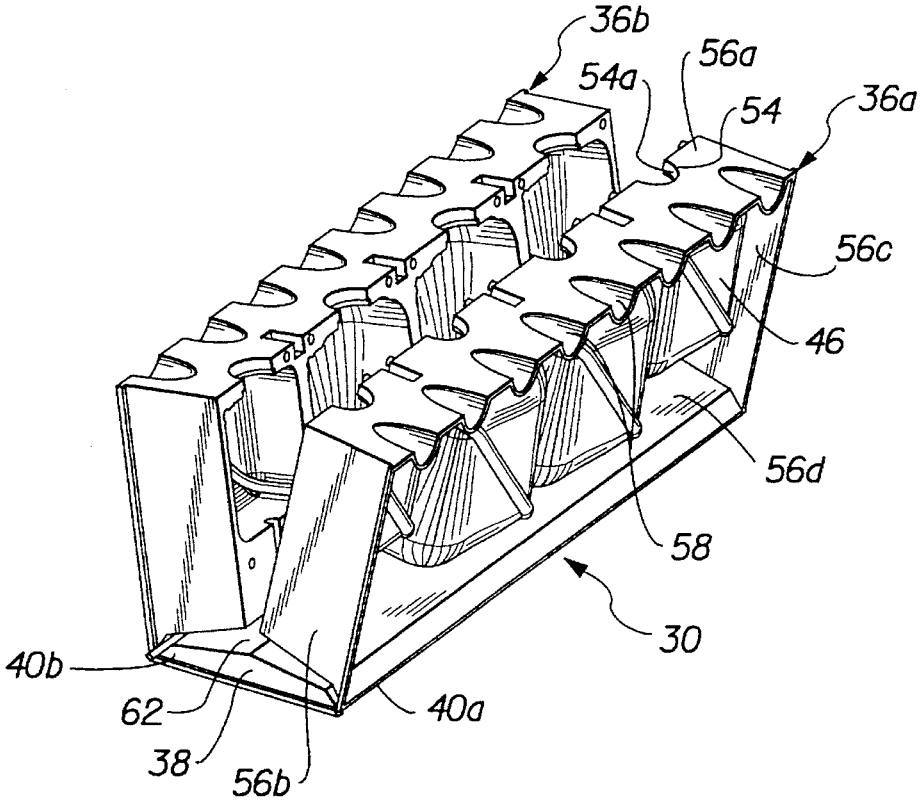
FIG. 4 is a another view in perspective of the internal packaging means of FIG. 3.

Referring jointly to FIGS. 1–4, a combined shipping and dispensing package 10 encloses a plurality of fluid containers 12*a*–12*d*. Each of the fluid containers comprises a collapsible container body 13 and a dispensing conduit 14. A circumferential retention channel 16 is defined on the outer periphery of the dispensing conduit between an encircling flange 18 and a reinforcing section 20 which is formed on the container body 13 around the junction between the conduit and the container body. A second flange 19 spaced slightly above the first flange 18 defines a clamping channel 21 adapted to be engaged by a slotted clamping plate (not shown) on associated photoprocessing equipment when the package is inverted and positioned with the dispensing conduits in engagement with mating fluid receptors on the equipment. A dispensing valve 22 inside the dispensing conduit 14 seals the contents inside the fluid containers until engagement with the fluid receptors on the associated equipment. Additionally, screw threads 23 on the conduit receive a threaded cap (not shown) for use during shipment and storage of the package.

Package 10 of the invention comprises an outer container 24 having sidewalls 26*a*–26*d* and internal packing means 30 for flexibly holding the fluid containers 12*a*–12*d* in a fixed position within the outer container. The outer container 24 is provided with a top closure which, in the illustrated embodiment, comprises hinged end flaps 32*a*, 32*b* and hinged side flaps 32*c*, 32*d* although it will be appreciated that other forms of top closure may be employed, such as a removable lid. Each of the side flaps 32*c*, 32*d* is provided with openings 34 which are sized and positioned such that, when the flaps are folded over to close the container 24, the openings align with and allow for extension of the dispensing conduits 14 out of the outer container 24.

Internal packing means 30 comprises first and second support members 36*a*, 36*b* and a base member 38 preferably integrally formed and hinged along hinge lines 40*a*, 40*b*. Each of the support members is essentially a mirror image of the other and therefore they will be described with reference to only one of the members 36*a*. The support member 36*a* includes a generally rigid, upstanding rib section 42 having a separate opening 44 therein for each of the fluid containers 12*a*–12*d*. A compliant jacket wall 46 extends outwardly from the rib opening 44 to form a partial cavity for receiving and supporting a fluid container placed in the cavity. Although the embodiment illustrated shows a package which is designed to accommodate four fluid containers, it will be appreciated that the structure may be modified to just one or a different plurality of fluid containers. In the illustrated embodiment, some of the fluid containers are of different sizes, and, in this case, the jacket walls preferably are sized and shaped to conform to the configuration of the different sized fluid containers. The jacket walls of the first and second support members 36*a* and 36*b* are complementary in form and when the support members are mated together with the fluid container inserted therein, the jacket walls substantially enclose the fluid container. A vent opening 48 is molded into the rib section at the bottom of the cavity to allow for entry of air as the fluid container collapses during dispensing of the fluid. Projections 50 on support member 36*a* engage mating depressions 52 on support member 36*b* to help align and hold the support members together. Spot welding of the abutting rib sections may also be employed to further hold the mated support members together.

A substantially rigid collar portion 54 is formed in the rib section 42 at an upper portion of each cavity 44. These collar portions are shaped to engage the conduit retention channels 14 when the fluid containers 12*a*–12*d* are placed in their respective cavities. Collar portions 54 are located on the support members in a common plane to facilitate attachment of the dispensing conduits to receptors in associated processing equipment without removal of the fluid containers from the outer container and further to align clamping channels 21 with the clamping plate on the equipment. The collar portion 54 includes a small, wall 54*a* which adds rigidity to the collar portion and enhances the support of the dispensing conduit 14 both for shipping and for attachment to the associated photo processing equipment.

The support member 36*a* is also provided with a plurality of compliant spacer members in the form of thin, continuous walls 56*a*–56*b* extending laterally away from the rib section 42. The walls are stiff enough to hold the rib section 42 in place within the container 24 spaced from side walls 26*c*, 26*d* but, at the same time, flex to some degree and thereby provide some cushioning and shock absorption against rough handling during shipping. Indentations 58 are formed in the upper spacer wall 56*a* to reduce the tendency of the thin wall to bow and to add a degree of rigidity to the wall. The lower spacer wall 56*d* is integrally formed with and hinged to the base member 58 along hinge line 40*a*. Each of the support members 36*a*, 36*b* has elongated slots or depressions 60*a*–60*c* cut or molded into the upper end of rib 42 and in upper spacer walls 56*a*. These slots or depressions serve as locating features for cooperation with mating locating features on the associated photographic processing apparatus to assure proper orientation of the package on the equipment and the dispensing of each photographic processing chemical to a correct corresponding receptor in the processing apparatus. Closure flaps 32*c*, 32*d* carry corresponding slots 61*a*–61*c* which align with the depressions 60*a*–60*c* in the internal packing 30. The proper orientation can be achieved by offsetting one or more of the depressions so as to be aligned closer to one set of openings 34 than the other. Additionally, the spacing between the openings and the corresponding spacing between the fluid containers within the internal packing or from the outer container sidewalls can be made asymmetrical to achieve the same orientation function. Still further, one or more of the slots 61*a*–61*c* can be omitted from the top closure of the outer container 24 to distinguish different packages while the same internal packaging means 30 can be used in all cases. This is useful to distinguish between packaging with solutions intended for photographic film processing and packaging with solutions intended for photographic paper processing.

The side-to-side width dimension of base member 38 between hinge lines 40*a*, 40*b* is sized to span the internal width between the two side walls 26*c*, 26*d* of the outer container 24. The internal packing 30 lends itself to being molded as a single integral structure from a plastic material, such low density polyethylene, using a thermoforming process. As a result, the thin spacer walls have a slight draft, i.e. extend at a slight angle from the rib section 42. To accommodate this, base member 38 is formed with a shallow triangular cross section such that the center line 62 of the base member 38 is raised to provide support to the rib sections 42 when the support members are folded into mating relation and placed within outer container 24. In a similar vein, base member 38 includes central recesses 63 with upstanding rib walls 64 to add rigidity to the base member thereby enhancing the support of the rib sections 42.

From the foregoing description it can be seen readily that when the support members 36*a*, 36*b* are folded up and mated together and inserted into the outer container 24 with the fluid containers 12*a*–12*d* in place, the rib sections 42 and collar portions 54 form a centralized internal support wall 66 resisting compressive forces on the dispensing conduits parallel to the support wall 66. The central wall also provides support against forces exerted against the two sidewalls 26*a*, 26*b* at the ends of the central wall. The compliant spacer members 56*a*–56*d* hold the internal support wall 66 in spaced relation from the outer container sidewalls 26*c*,26*d* thereby holding the dispensing conduits 14 in lateral alignment with the top closure opening. The compliant spacer walls 56*a*–56*d* and compliant jacket walls 46 jointly provide shock absorption for the fluid container during shipping.

The invention has been described with reference to a preferred embodiment. However, it will be appreciated that variations and modifications can be effected by a person of ordinary skill in the art without departing from the scope of the invention.

PARTS LIST

10 combined shipping and dispensing package
12*a–d* fluid containers
13 container body
14 dispensing conduit
16 retention channel
18 flange
19 flange
20 reinforcing section
21 clamping channel
22 dispensing valve
23 screw thread
24 outer container
26*a–d* side walls
30 internal packing means
32*a–d* top closure flaps
34 top closure openings
36*a–b* support members
38 base member
40*a–b* hinge lines
42 rib section
44 cavity opening
46 jacket wall
48 vent opening
50 projections
52 depressions
54 collar portion
56*a*–56*d* spacer member walls
58 indentations
60*a*–60*c* depressions
61*a*–61*c* closure slots
62 base member center line
63 base member recess
64 rib wall
66 central internal support wall

What is claimed is:

1. A combined shipping and dispensing package for enclosing at least one fluid container, the fluid container including a dispensing conduit having a retention channel on the outer periphery thereof, said package comprising:

an outer container having a bottom wall, sidewalls, and a top closure, the top closure having an opening for extension therethrough of said dispensing conduit; and internal packing means for flexibly holding said fluid container in a fixed position within said outer container, said packing means comprising first and second mating support members, each support member having:

(a) a substantially rigid, upstanding rib section having an opening defined therein, (b) a compliant jacket wall extending outwardly from the rib opening to form a partial cavity for receiving and supporting a fluid container placed in the cavity, (b) a substantially rigid collar portion formed in the rib section at an upper portion of the cavity and shaped to engage said conduit retention channel of the fluid container when placed in said cavity, and (c) a plurality of compliant spacer members extending laterally from the rib section, whereby when said support members are mated together and inserted into said outer container with said fluid container in place, said ribs and collar portions form a centralized internal support wall resisting compressive forces on said dispensing conduit parallel to the support wall, and said compliant spacer members hold said internal support wall in spaced relation from the outer container sidewalls thereby holding said dispensing conduit in lateral alignment with said top closure opening, said compliant spacer members and compliant jacket walls jointly providing shock absorption for said fluid container during shipping.

2. The package of claim 1 wherein said package encloses a plurality of fluid containers, each having said dispersing conduit, wherein said top closure has an opening for each of said dispensing conduits, wherein said rib section has a corresponding number of openings, each of which is provided with said flexible jacket wall to form a separate cavity for each fluid container and wherein separate said collar portions are formed in said rib portion at an upper portion of each separate cavity.

3. A package according to claim 2 wherein at least some of said fluid containers are of different sizes from each other and said jacket walls are sized and shaped to conform to the configuration of said different sized fluid containers.

4. A package according to claim 2 wherein said spacer members comprise compliant, continuous side walls integrally formed on all sides of said rib section and at least one of said continuous side walls includes reinforcing indentation's formed therein to reduce bowing of the reinforced sidewall.

5. A package according to claim 1 wherein said outer container has two sidewalls spaced apart by a given internal width; and said internal packing means includes a base member having a width dimension spanning said internal width of the outer container, said base member being adapted to fit beneath said support members when inserted into the outer container.

6. A package according to claim 5 wherein said first and second support members are integrally formed with said base member and are hinged to the base member.

7. A package according to claim 4 wherein said spacer members comprise compliant, continuous side walls integrally formed on all sides of said rib section, one of said continuous side walls being integrally formed with and hinged with said base member.

8. A package according to claim 1 wherein the outwardly extending jacket walls of said first and second support members are complementary in form and when said support members are mated together with said fluid container inserted therein, said jacket walls substantially enclose said fluid container.

9. A package according to claim 2 or 3 wherein said collar portions are located on said support members in a common plane to facilitate attachment of the dispensing conduits to receptors in associated processing equipment without removal of the fluid containers from the outer container.

10. A package according to claim 2 or 3 wherein said fluid containers each contain a different photographic processing chemical.

11. A package according to claim 10 wherein at least one of said support members comprises at least one locating feature for cooperation with an associated photographic processing apparatus to assure dispensing of each photographic processing chemical to a correct receptor in the processing apparatus.

12. A package according to claim 11 wherein said outer container includes an aligned opening for access to said locating feature.

13. A package according to claim 1 wherein said closure comprises at least a pair of folding flaps, each flap having an opening which align together over the dispenser conduit when the flaps are folded to close the outer container.

* * * * *